United States Patent [19]

Schweitzer

[11] 4,024,655

[45] May 24, 1977

[54] CUTTING AND FEEDING MECHANISM FOR SUCTION INLET

[76] Inventor: Karl Friedrich Schweitzer, D-5605 Hochdhl, Germany

[22] Filed: July 7, 1975

[21] Appl. No.: 593,506

[30] Foreign Application Priority Data

July 5, 1974 Germany ..... 2432286

[52] U.S. Cl. ..... 37/58; 37/71; 37/141 R; 37/187; 302/15

[51] Int. Cl.[2] ..... E02F 3/92

[58] Field of Search ..... 37/54, 58, 71, 183 R, 37/187, 2 R, 141 R, 103, 64; 302/15, 58

[56] References Cited

UNITED STATES PATENTS

| | | | |
|---|---|---|---|
| 2,652,641 | 9/1953 | Zowaski | 37/141 R |
| 2,889,642 | 6/1959 | Stein | 37/71 UX |
| 3,531,161 | 9/1970 | Conn | 37/103 |
| 3,693,274 | 9/1972 | Piccagli | 37/71 X |

FOREIGN PATENTS OR APPLICATIONS

| | | | |
|---|---|---|---|
| 386,348 | 4/1965 | Switzerland | 37/58 |
| 1,010,489 | 11/1965 | United Kingdom | 37/2 R |
| 323,407 | 1/1930 | United Kingdom | 37/58 |

*Primary Examiner*—Edgar S. Burr
*Assistant Examiner*—Steven A. Bratlie
*Attorney, Agent, or Firm*—Ernest F. Marmorek

[57] ABSTRACT

A suction pipe device for suction dredgers having at least two functionally opposed combined cutter and crusher tools mounted near the bottom opening of the suction pipe, to cut and crush and feed material to be dredged.

3 Claims, 3 Drawing Figures

CUTTING AND FEEDING MECHANISM FOR SUCTION INLET

BACKGROUND OF THE INVENTION

The present invention relates to a suction pipe for suction dredgers with mechanical feeder and cutter means adapted to handle the material dredged. Suction dredgers of this type are adopted in large numbers to condition the beds of lakes and stream courses. It is already known in the art to associate mechanical feeder and cutter means with the suction pipes for dredging purposes.

It is likewise known in the art that these feeder means as such impose a load torque on the suction pipe which the pipe would pass on to the bottom of the dredge vessel so that suction pipe and vessel bottom must be of greater size than otherwise required.

On the other hand there are deadcycle times involved in the process for sucking material from below the water surface for suction dredgers and other hydraulic conveyors whenever larger size rocks are caught in front of the suction pipe, and in general wherever rock and clay material is to be handled.

It is a purpose therefore of hydraulic bottom rippers or dredgers and stone crushers to excavate rocks and clay formations directly in front of the suction pipe and at the same time crush larger size rocks so that they conveniently can be conveyed through the suction pipe. Equipment of this type is also known as cutters.

The dredgers on the market at present are called cutter-head dredgers because their cutter equipment is adapted to rip the bottom by rotational movement in front of or adjacent the suction pipe. Their general drawback resides in that resultant load torques are transferred either upon the suction pipe proper or, by means of a lattice construction, upon the dredge vessel.

SUMMARY OF THE INVENTION

One of the principal objects of the present invention is to overcome the drawbacks of these prior art arrangements and to provide a feeder and cutter system for suction dredgers which in spite of increased capacity operates substantially in the absence of load torques.

According to the invention the problem, broadly speaking, is solved in that at least two functionally opposed cutter and crusher tools actuatable by hydraulic cyclinders are provided, and each is rotatable about a pivot mounted relative to the suction pipe; the cylinders move the tools in opposite directions.

BRIEF DESCRIPTION OF THE DRAWINGS

The foregoing and other objects of the invention will be best understood from the following description of an exemplification thereof, reference being had to the accompanying drawings, wherein.

DESCRIPTION OF THE PREFERRED EMBODIMENT

Figure 1:
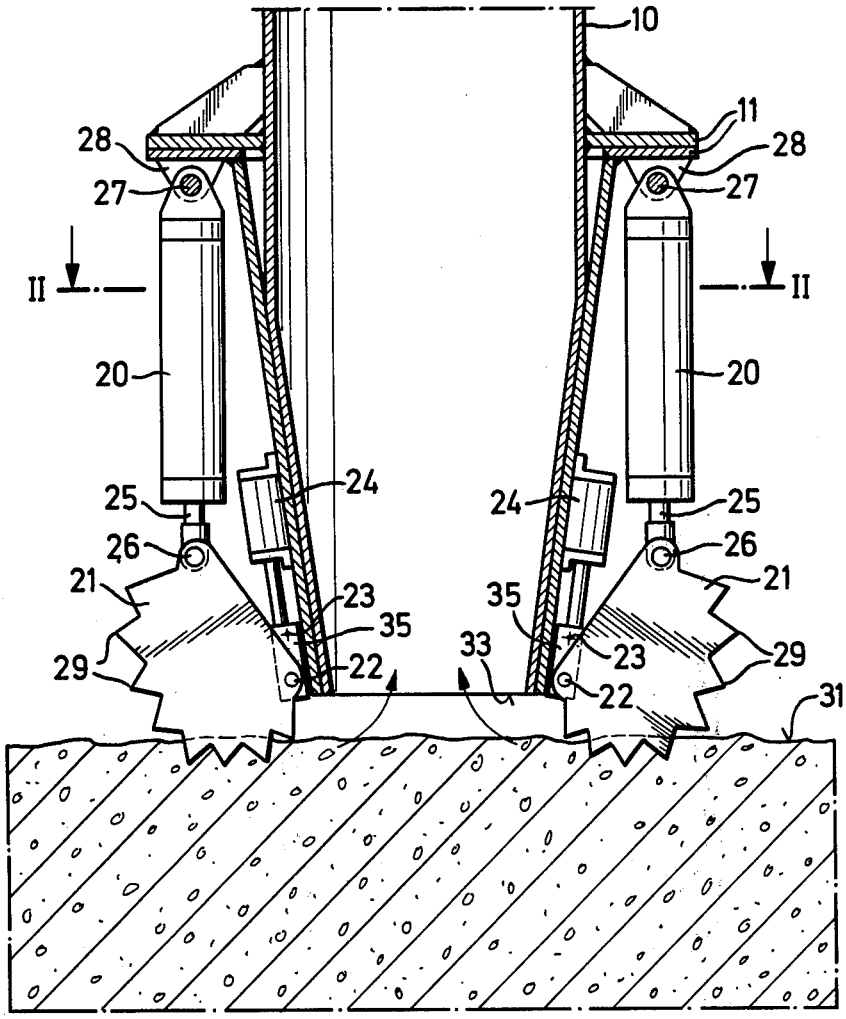
FIG. 1 is a partial sectional view of a suction pipe with counteracting cylinders and cutter tools thereto attached, shown near the beginning of a cutting stroke.

In carrying the invention into effect in one of the embodiments which has been selected for illustration in the accompanying drawings and for description in this specification, and referring now particularly to FIG. 1, an important feature of the invention is that two or more laterally arranged hydraulic cylinders are provided to rotate the cutter and crusher tools 21 about one pivot 22, 23 each in opposed sense. Said hydraulic cylinders 20 moreover have their stroke travels synchronized so that the forces produced are completely transmitted upon the cutter and crusher means and there is no torque load imposed on the suction pipe 10 or the dredge vessel and only a relatively insignifigant vertical load so that the feeder and cutter system can also be attached to existing conveyor equipment without there being need for major modifications to be effected thereto.

The feeder and cutter system comprises fixing and retaining means 11 disposed on the suction pipe 10, hydraulic cylinders 20 including piston rods 25, bearing joints 26, 27 with corresponding bearing blocks 28, and cutter and crusher tools 21 including cutting edges 29 and spacers 30.

Figure 1A:
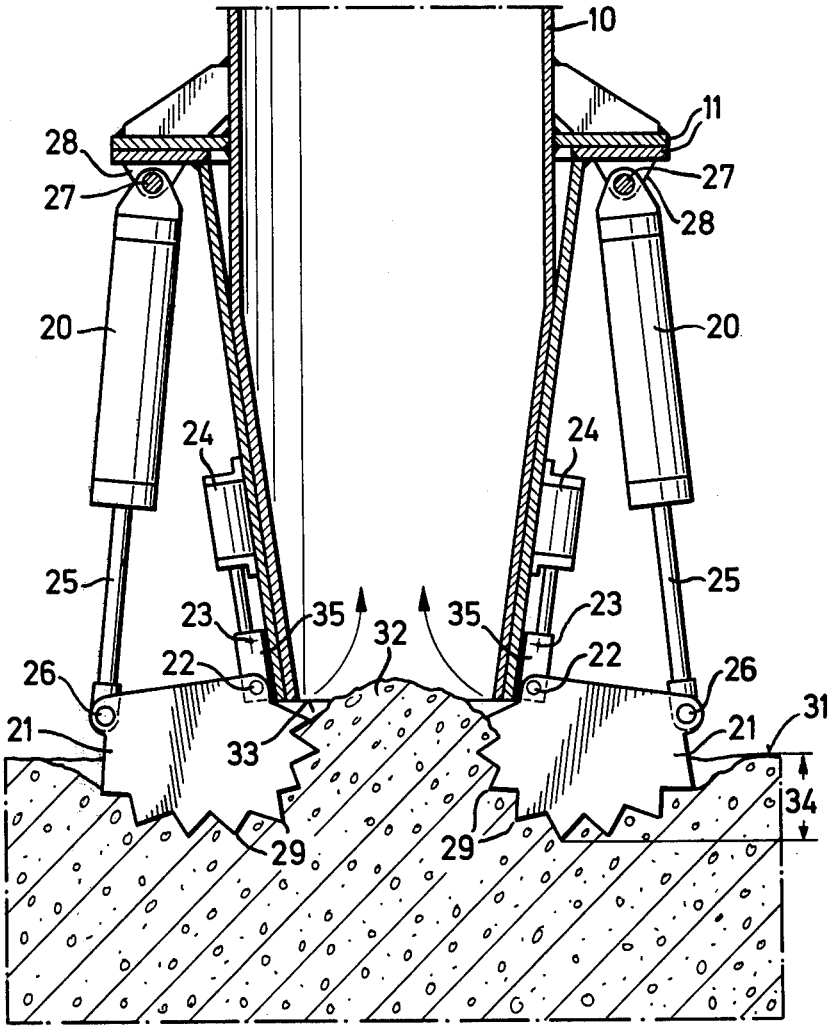
FIG. 1*a* is similar to FIG. 1 except the cutter tools are shown near the end of a cutting stroke.
Figure 2:
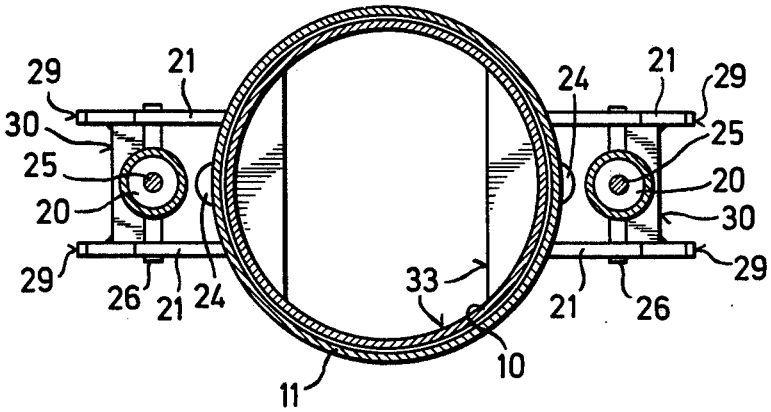
FIG. 2 is a bottom plan view of the suction pipe and tools shown in FIG. 1.

Cutter and crusher tools 21 are shown in a preferred embodiment, disposed symmetrically on the suction pipe 10 in FIG. 2. There are two disk-like tools 21 shown secured together with bridging means 30, on each side of the suction pipe 10, shown in FIG. 2. Sawtooth edges 29 are shown in FIGS. 1–1*a*, formed on the edge of the disk-like tools 21.

Operation

Operation of a suction pipe thus equipped is rather simple. As the pistons of the hydraulic cylinders 20 are moved, this movement is analogously transmitted upon and imparted to the cutter and crusher tools which by their saw edges 29 rip the bottom 31 and push the material cut 32 to in front of the suction pipe mouth 33 (FIG. 1*a*). Larger size rocks are reduced in size between said cutter and crusher tools 21. Continuous feeding of material ensures a substantially continuous performance of the suction pipe.

Another essential feature of the present invention resides in that the pivot 22, 23 can be vertically varied between a bottom pivot 22 and a top pivot 23. The position of said pivot determines the cutting depth 34. Normally the elevation of said pivot 22, 23 also is adjustable which means that additional hydraulic cylinders 24 with sliding blacks 35 are fitted on the suction pipe 10.

Any hydraulic conveyor can be combined with the feeder and cutter system of the present invention to form a dredger unit adapted for continuous performance and suitable for use also to excavate in depths down to more than 100 m below the water surface.

Utilization of the feeder and cutter system of the present invention not only affords the essential advantage of keeping loads away from the suction pipe and the vessel structure, but also increases the output by up more than to 100%. Depending on its design and construction the system crushes rock greater than 1 m in diameter in a matter of seconds, loosens conglomerate layers and excavates clay formations.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. In a suction feed device for suction dredges, in combination:

a suction pipe defining an inlet opening near an end;

a pivot means secured to said pipe and forming two pivot points disposed near said opening on opposite sides of said pipe, said pivot means further including a shifting device operable for shifting said pivot points substantially parallel along the side of said suction pipe;

combined mechanical feeder and cutting means mounted with relation to said pipe and including two pairs of disk-like cutter and crusher tools having arcuate edges saw-toothed throughout, each said pair being secured to and partially rotatable about a corresponding one of said pivot points; and means operable for rotating each tool about its pivot point to cut and crush and feed into said opening, material to be dredged.

2. In a suction device, as claimed in claim 1, said means for rotating said tools comprising a fluid cylinder for each tool.

3. In a suction device, as claimed in claim 2, said fluid cylinder comprising a hydraulic cylinder.

* * * * *